US005620533A

United States Patent [19]

Kotani et al.

[11] Patent Number: 5,620,533

[45] Date of Patent: Apr. 15, 1997

[54] METHOD FOR MAKING GRAIN-ORIENTED SILICON STEEL SHEET HAVING EXCELLENT MAGNETIC PROPERTIES

[75] Inventors: Keisuke Kotani; Mitsumasa Kurosawa; Masaki Kawano; Hirotake Ishitobi; Masayuki Sakaguchi; Takafumi Suzuki, all of Okayama; Ujihiro Nishiike, Tokyo, all of Japan

[73] Assignee: Kawasaki Steel Corporation, Japan

[21] Appl. No.: 533,841

[22] Filed: Sep. 26, 1995

[30] Foreign Application Priority Data

Jun. 28, 1995 [JP] Japan ..... 7-161955

[51] Int. Cl.[6] ..... H01F 1/04

[52] U.S. Cl. ..... 148/113; 148/111

[58] Field of Search ..... 148/111, 112, 148/113

[56] References Cited

U.S. PATENT DOCUMENTS

| | | | |
|---|---|---|---|
| 4,200,477 | 4/1980 | Datta et al. | 148/113 |
| 4,213,804 | 7/1980 | Datta | 148/113 |

FOREIGN PATENT DOCUMENTS

| | | | |
|---|---|---|---|
| 0305966 | 3/1989 | European Pat. Off. | 148/113 |
| 1-119622 | 5/1989 | Japan | 148/113 |
| 4-350124 | 12/1992 | Japan | 148/111 |
| 5-263135 | 10/1993 | Japan | 148/111 |

*Primary Examiner*—John Sheehan
*Attorney, Agent, or Firm*—Austin R. Miller

[57] ABSTRACT

A method for producing a grain-oriented silicon steel sheet in the coil shape having high magnetic induction and including AlN and MnSe as principal inhibitors is disclosed. In a series of processes for producing a grain-oriented silicon steel sheet, the oxide content on the steel sheet surface is controlled within a range of about 0.02 to 0.10 g/m$^2$ before the temperature elevation phase of a decarburization annealing process, and the ratio of the steam partial pressure to the hydrogen partial pressure is controlled within a range of about 0.2 to 0.65 at a steel sheet surface temperature ranging from about 500° to 750° C. during the temperature elevation phase in a decarburization annealing process. The method promotes stable secondary recrystallized grain formation even in different coils or at different places in the same coil, such that fluctuation of magnetic properties is depressed.

4 Claims, 3 Drawing Sheets

METHOD FOR MAKING GRAIN-ORIENTED SILICON STEEL SHEET HAVING EXCELLENT MAGNETIC PROPERTIES

BACKGROUND OF THE INVENTION

1. Field of the Invention

The present invention relates to a method for making a grain-oriented silicon steel sheet having excellent magnetic properties that remain consistent between different production lots and within individual sheets.

2. Description of the Related Art

Grain-oriented silicon steel sheets are mainly used as iron core materials for transformers and other electric devices. Required magnetic properties of iron core materials include high magnetic induction at a magnetic field of 800 A/m ($B_8$, in units T); low core loss, i.e., low alternating current core loss at 50 Hz in 1.7 T of the maximum magnetic induction ($W_{17/50}$, in units W/kg); and the like.

Recent trends have required higher magnetic induction ($B_8 \geqq 1.92$) in order to reduce core weight and noise. Furthermore, to improve fabrication efficiency and yield in large size transformers, homogeneous material characteristics are needed.

A grain-oriented silicon steel sheet is obtained by growing crystal grains of {110} <001> orientation, known as Goss orientation, by secondary recrystallization.

The following processes are involved in the production of a grain-oriented silicon steel sheet: heating and rolling at high temperature a silicon steel slab containing inhibitors required for secondary recrystallization, such as precipitates of MnS, MnSe, AlN and the like; cold-rolling the silicon steel sheet at low temperature at least once, or two or more times with intermediate annealing, to attain a final thickness; decarburization annealing the silicon steel sheet; applying an annealing separating agent such as MgO or the like to the steel sheet; and final annealing in the coil shape. Secondary recrystallization occurs during the final annealing process. An insulating coating comprising forsterite also forms during the final annealing process. Additional annealing after hot-rolling or during cold-rolling may be incorporated, and cold-rolling temperature may be raised as necessary.

Achieving further improvement in the magnetic properties requires a higher degree of secondary crystal grain growth in the Goss orientation. An effective means for producing such a result is to increase the rolling reduction to between 80–95% during final cold-rolling. However, when the rolling reduction during final cold-rolling reaches 80–95%, secondary recrystallization becomes very unstable, particularly in sheet steel less than 0.23 mm thick.

As a means for stabilizing secondary recrystallization when an increased rolling reduction is used during final cold-rolling, Japanese Patent Publication No. 62-50529 discloses a limited decarburization using AlN and MnS as principal inhibitors, such that carbon content is reduced by 0.0070 to 0.030 wt % after the hot-rolling process and before the cold-rolling process. However, $B_8$ of the resulting products is only 1.92 T on average, thus the desired value of 1.92 T cannot be consistently obtained. Furthermore, the prior art does not disclose materials utilizing AlN and MnSe as principal inhibitors.

Because the coexistence of AlN and MnSe enables multimodal precipitation, AlN and MnSe can finely disperse, thereby enhancing the inhibition effect. However, the presence of MnSe also renders insulating coating formation more difficult.

Japanese Patent Laid-Open No. 4-202713 discloses that controlling ambient temperature within a suitable range during the temperature elevation and soaking temperature in the decarburization annealing process improves coating properties and magnetic properties. The effects of oxides on the steel surface before the temperature increase, however, is not considered. Further, when this prior art technique is applied to materials containing AlN and MnSe as principal inhibitors magnetic properties over the entire product coil are inconsistent because secondary recrystallization at the middle portion of the coil is unstable.

As described above, no method for producing a coil-shaped, grain-oriented silicon steel sheet which possesses consistently excellent and stable magnetic properties has been found where AlN and MnSe are employed as inhibitors to promote high magnetic induction.

SUMMARY OF THE INVENTION

It is an object of this invention to provide a production method for a grain-oriented silicon steel sheet having consistently excellent and stable magnetic properties in the coil shape and having high magnetic induction through the utilization of AlN and MnSe as principal inhibitors.

This invention is directed to the stabilization of magnetic properties at a high-quality level by stabilizing secondary recrystallization. The invention achieves stable secondary recrystallization by promoting the integration of secondary crystallized grain to the Goss orientation by raising the rolling reduction in the final cold-rolling to about 80–95%, decreasing oxide content before elevating the temperature for the decarburization annealing process, and controlling oxide composition and morphology formed at an early stage adjacent to the iron matrix-oxide interface by decreasing atmospheric oxidization which occurs during the temperature elevation phase in the decarburization annealing process.

Accordingly, this invention is directed to a method for producing a grain-oriented silicon steel sheet comprising a series of processes, including performing hot-rolling process on a silicon steel slab containing about 0.02 to 0.15 wt % Mn, about 0.005 to 0.060 wt % Se, about 0.010 to 0.06 wt % Al, and about 0.0030 to 0.0120 wt % N as inhibitor forming components; performing at least one cold-rolling process including a final cold-rolling process to reach final thickness, as well as optional intermediate annealing processes between consecutive cold-rollings; performing decarburization annealing; and then performing the final annealing process after applying an annealing separating agent such that the oxide content on the steel sheet surface is controlled within a range of about 0.02 to 0.10 g/m$^2$ before the temperature elevation phase of the decarburization annealing process; controlling the ratio of the steam partial pressure to the hydrogen partial pressure in the decarburization annealing atmosphere within a range of about 0.3 to 0.5 as the steel sheet surface temperature ranges from about 500° to 750° C. during the temperature elevation phase of the decarburization annealing process; and controlling the ratio of the steam partial pressure to the hydrogen partial pressure in the decarburization annealing atmosphere within a range of about 0.5 to 0.8 when the steel sheet surface temperature ranges from about 750° to 850° C. during decarburization annealing.

This invention is further directed to a method for producing a grain-oriented silicon steel sheet, wherein by adding about 0.03 to 0.20 wt % Cu, the ratio of the steam partial pressure to the hydrogen partial pressure in the decarburization annealing atmosphere is controlled within a range of about 0.2 to 0.65 when the surface temperature of the steel sheet during the temperature elevation phase of the decarburization annealing ranges from about 500° to 750° C.

The invention promotes the formation of stable secondary recrystallized grains in different coils or at different places in the same coil, thereby depressing undesirable fluctuations in magnetic properties.

DETAILED DESCRIPTION OF THE PREFERRED EMBODIMENTS

Figure 1:
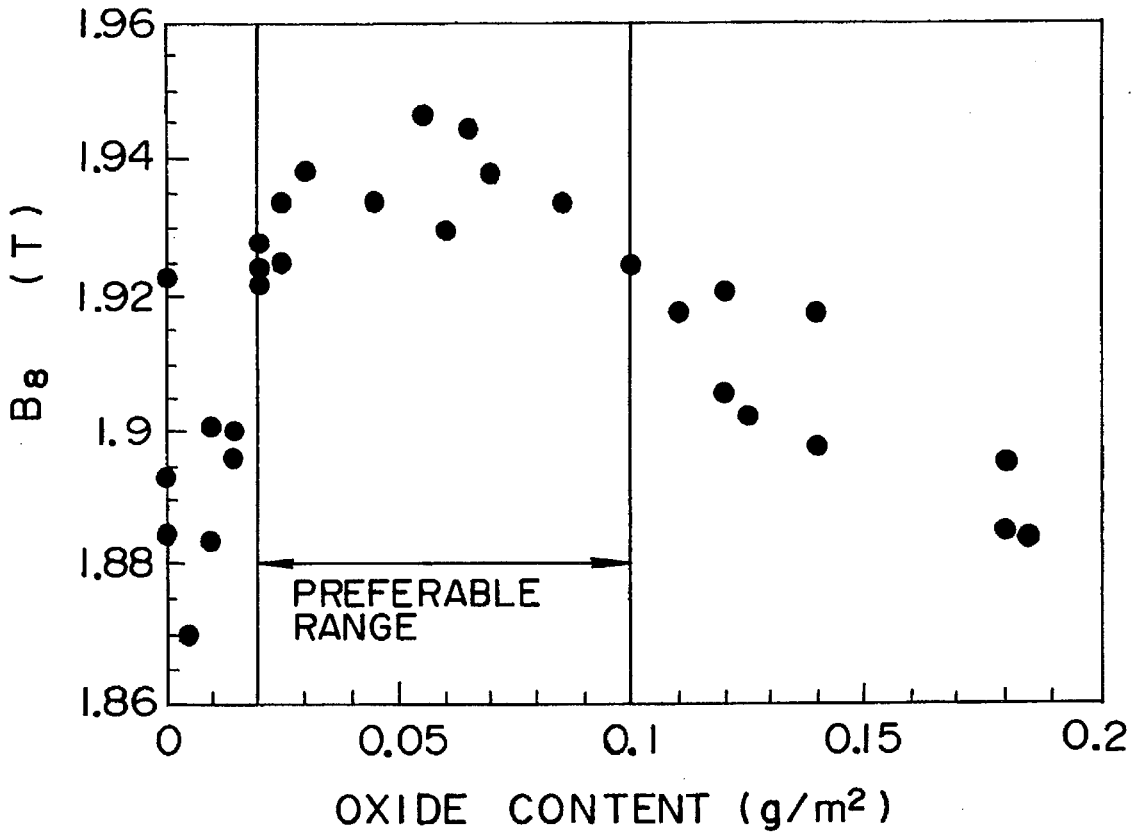
FIG. 1 is a graph illustrating the correlation between magnetic induction and the oxide content in the steel sheet before the temperature elevation phase of a decarburization annealing process.

We have intensively studied secondary recrystallization behavior of the grain-oriented silicon steel sheet when the rolling reduction at the final cold-rolling is raised to about 80–95% while using MnSe and AlN inhibitors. We have discovered that surface oxides, which form near the iron matrix interface during the temperature elevation phase in a decarburization annealing process, affect dissociation and surface reaction of inhibitors during secondary recrystallization annealing and thus determine whether secondary recrystallization will occur. These effects are remarkably strong at the middle section of coil during the final annealing process carried out in the coil shape because of inadequate gas flow to those areas.

Accordingly, by controlling the oxide content on the steel surface before the temperature elevation phase of a decarburization annealing process, and by controlling the decarburization annealing atmosphere ("oxidizing atmosphere") during the temperature elevation phase of a decarburization annealing process, a coil having stable and consistent magnetic properties can be produced as a result of (1) the uniform surface oxide formation near the iron matrix interface, and (2) stable secondary recrystallization at the middle section of the coil.

The investigations through which the present invention was discovered will now be detailed.

First, the effect of oxide content formed on the steel sheet surface before the temperature elevation phase of a decarburization annealing process on the stability of the magnetic properties of the products and the secondary recrystallization were investigated. The oxide content formed on the steel sheet surface represents the oxygen content ($g/m^2$) per unit area existing in the area from the sheet surface to the 0.8 μm depth of the sheet. The oxides are formed as inner oxide layers during intermediate annealing and cold-rolling, which generally involve heat generation by the processing, and during rolling at high temperature and aging. The oxide content is usually about 0.1 to 0.2 $g/m^2$ immediately after the final cold-rolling.

The experimental procedure is as follows: A slab containing 0.078 wt % C, 3.25 wt % Si, 0.08 wt % Mn, 0.022 wt % Se, 0,024 wt % Al, and 0.0090 wt % N was rolled at high temperature (hot-rolled) to form a hot-rolled sheet; The hot-rolled sheet was rolled at low temperature (cold-rolled), annealed at 1100° C., and again cold-rolled at 85% of final rolling reduction to form a cold-rolled sheet 0.23 mm thick. After decarburization annealing and applying an annealing separation agent, the final annealing was performed to form a final product. The magnetic properties of the final product were then measured. The oxide content remaining on the surface of resulting steel sheet was controlled by various acid cleaning and brushing techniques. In the decarburization annealing process, the oxidizing atmosphere, i.e. the ratio of the steam partial pressure to the hydrogen partial pressure ($P(H_2O)/P(H_2)$), during the temperature elevation between 500° and 750° C. was controlled to 0.45. The soaking temperature was 840° C., during which $P(H_2O)/P(H_2)$ was 0.55. The results are shown in FIG. 1.

FIG. 1 shows that by controlling the oxide content on the steel surface to about 0.02 to 0.10 $g/m^2$, the magnetic induction ($B_8$) exceeds 1.92 T, thereby indicating stabilized secondary recrystallization.

Then, the effects of the atmosphere during the temperature elevation in a decarburization annealing process were investigated. Maintaining the atmosphere over a steel surface temperature range between about 500° and 750° C. before reaching the decarburization temperature range is particularly important as is demonstrated in the following experiments.

A slab containing 0,078 wt % C, 3.25 wt % Si, 0.08 wt % Mn, 0,022 wt % Se, 0.024 wt % Al, and 0.0090 wt % N was hot-rolled to make a hot-rolled sheet. The hot-rolled sheet was cold-rolled, annealed at 1100° C., and again cold-rolled at 85% of final rolling reduction to make a cold-rolled sheet 0.23 mm thick.

The oxide content before decarburization annealing was adjusted to 0.05 $g/m^2$. During the decarburization annealing process, the oxidizing atmosphere $P(H_2O)/P(H_2)$ over the elevating temperature range of 500° to 750° C. was controlled to various values. $P(H_2O)/P(H_2)$ in the temperature range from 750° to 850° C. was controlled to 0.6.

After decarburization annealing and applying an annealing separation agent, a final annealing was performed on the cold-rolled sheet to produce a final product. The magnetic properties of the final product were then measured.

Figure 2:
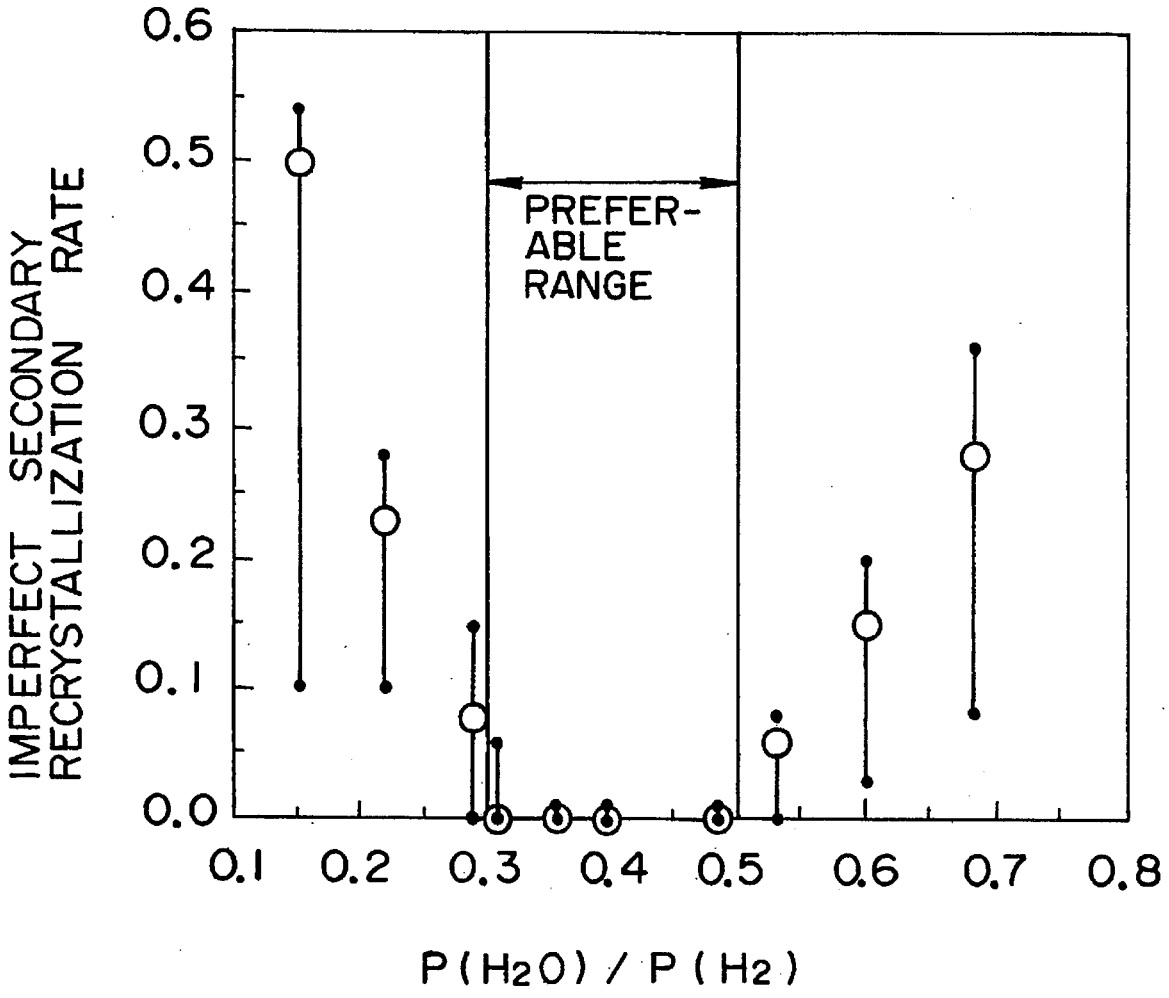
FIG. 2 is a graph showing the correlation between the oxidation atmosphere and imperfect secondary recrystallization rate during the temperature elevation phase of a decarburization annealing process.

Imperfect secondary recrystallization was indicated by a magnetic induction ($B_8$) of less than 1.92 T. In FIG. 2, the imperfect secondary recrystallization rate represents the ratio of the length of the imperfectly secondary recrystallized portion of the coil to the entire coil length. FIG. 2 clearly shows that the imperfect secondary recrystallization rate increases when $P(H_2O)/P(H_2)$ is outside the range of about 0.3 to 0.5 during the temperature elevation phase (between about 500° and 750° C.) of the decarburization annealing. Thus, stable secondary recrystallization essentially requires controlling $P(H_2O)/P(H_2)$ during the temperature elevation phase of the decarburization annealing process in the range of about 0.3 to 0.5.

Stabilization of the secondary recrystallization by controlling the surface oxides before the decarburization annealing temperature elevation phase, and by controlling the oxidizing atmosphere during that elevation phase, is believed to occur through the following mechanism.

Oxides of Fe and Si having various compositions (e.g., silica and fayalite) are formed in various morphologies (e.g., epitaxial growth on the crystal axis of the matrix iron and dispersion in an amorphous state) on the steel sheet surface after decarburization annealing. In the subsequent annealing process, inhibitors in the steel sheet migrate or dissociate. The migration or dissociation is carried out through oxides on the steel sheet, depending on the atmosphere. Through migration or dissociation of the inhibitors, grain boundary migration becomes feasible so that secondary recrystallization occurs. Therefore, the secondary recrystallization greatly depends on the oxides on the steel sheet surface after decarburization annealing, and on the atmosphere.

Accordingly, stabilization of oxide composition and morphology on the steel sheet surface after decarburization annealing stabilizes secondary recrystallization. The factor controlling the oxide composition and morphology on the steel sheet surface after decarburization annealing is the state of oxides at the iron matrix-oxide interface of the steel sheet, i.e. initial oxides. Although it is yet unclear which compositions and morphologies of the initial oxides are preferred, suitable surface conditions can be obtained by controlling the oxide content before the temperature elevation phase of a decarburization annealing process and the oxidizing atmosphere during that temperature elevation phase, so that secondary recrystallization becomes stable. The effect is especially remarkable in the middle section of the coil where gas flow is low, particularly during final annealing.

The effect of adding Cu to the steel on the stabilization of secondary recrystallization will now be detailed.

We have studied various means for spreading the range of the oxidizing atmosphere during the temperature elevation phase of decarburization annealing, and found that steels containing about 0.03 to 0.20 wt % Cu permit secondary recrystallized grain to be stably obtained over a wider range of oxidizing atmosphere $P(H_2O)/P(H_2)$.

A slab containing 0.078 wt % C, 3.25 wt % Si, 0.08 wt % Mn, 0.022 wt % Se, 0.024 wt % Al, 0.0090 wt % N, and 0.12 wt % Cu was hot-rolled to make a hot-rolled sheet. The hot-rolled sheet was cold-rolled, annealed at 1100° C., and again cold-rolled at 85% of final rolling reduction to make a cold-rolled sheet 0.23 mm thick. After decarburization annealing and applying an annealing separation agent, a final annealing was performed to make a final product. The magnetic properties of the final product were then measured.

The oxide content before decarburization annealing was adjusted to 0.05 g/m$^2$. During the decarburization annealing process, $P(H_2O)/P(H_2)$ over the elevating temperature range of 500° to 750° C. was controlled to various values. $P(H_2O)/P(H_2)$ in the temperature range from 750° to 850° C. was maintained at 0.6. The results of the imperfect secondary recrystallization rate of various final products containing Cu are shown in FIG. 3.

Figure 3:
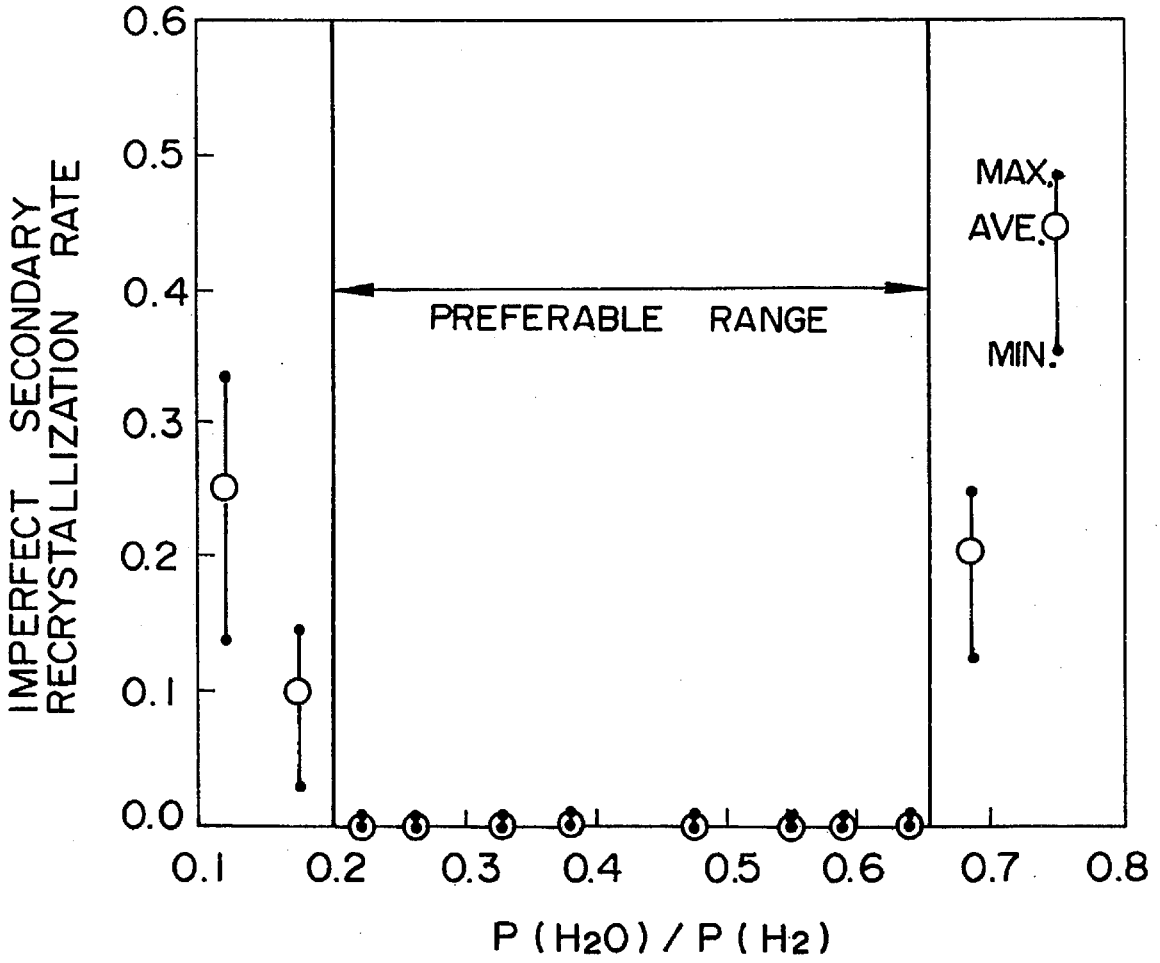
FIG. 3 is a graph showing the correlation between the oxidation atmosphere and imperfect secondary recrystallization rate during the temperature elevation phase of a decarburization annealing process in case of Cu-added steel sheet.

FIG. 3 clearly shows that the preferable $P(H_2O)/P(H_2)$ range over the decarburization annealing temperature elevation phase range of 500° to 750° C. is from about 0.2 to 0.65, which enables stable and consistently excellent magnetic properties to be obtained.

However, a Cu content over about 0.20 wt % causes Cu-Se to precipitate, which has a harmful effect on secondary recrystallization and deteriorates magnetic properties. These effects are not seen when less than about 0.03 wt % is added. Such results suggest that Cu affects surface oxide formation.

The quantity limits on elemental components of the present invention will now be explained.

C content in the silicon steel slab should be in a range of about 0.04 to 0.12 wt %. Steels with C content under about 0.04 wt % do not form suitable textures during the hot-rolling process;consequently, the final product does not possess suitable magnetic properties. On the other hand, steels with C content over about 0.12 wt % are hard to satisfactorily decarburize during the decarburization annealing process; therefore, secondary recrystallization cannot be normally carried out.

The Si content in the steel slab should be in a range of about 2.0 to 4.5 wt %. A final product containing less than about 2.0 wt % Si does not possess satisfactory magnetic properties. On the other hand, when Si content is over about 4.5 wt %, industrial working is difficult because of poor secondary recrystallization and poor formability.

The silicon steel slab containing the above components should also contain the components described below.

The steel should contain about 0.02 to 0.15 wt % Mn. An Mn content under about 0.02 wt % causes poor formability during hot-rolling and markedly poor surface characteristics. Further, the lack of MnSe inhibitor essential for secondary recrystallization causes imperfect secondary recrystallization. On the other hand, when the Mn content exceeds about 0.15 wt %, the slab heating temperature during the hot-rolling process needs to be set at a higher temperature in order to completely form the solid solution of MnSe, thereby increasing processing costs while deteriorating the surface characteristics of the slab.

The Se content in the steel should be in a range of about 0.005 to 0.06 wt %. An Se content less than about 0.005 wt % causes imperfect secondary recrystallization due to the lack of MnSe inhibitor. On the other hand, when the Se content exceeds about 0.06 wt %, the slab heating temperature during the hot-rolling process needs to be raised in order to completely form the solid solution of MnSe, thereby increasing processing costs while deteriorating the surface characteristics of the slab.

The Al content of the slab should be in a range of about 0.010 to 0.06 wt %. An Al content less than about 0.010 wt % causes imperfect secondary recrystallization due to the lack of AlN inhibitor. On the other hand, when Al content exceeds about 0.06 wt %, the growth of AlN grain after hot-rolling decreases the action of the inhibitor such that normal secondary recrystallization will not occur.

The N content in the steel should be in a range of about 0.0030 to 0.0120 wt %. An N content less than about 0.0030 wt % causes imperfect secondary recrystallization due to the lack of AlN inhibitor. On the other hand, when N content exceeds about 0.0120 wt %, surface blisters formed during the slab heating process deteriorate the surface characteristics.

Any other well known element which can form a inhibitor, for example, Sb, Sn, Bi, B and the like, may be added.

As described above, the grain-oriented silicon steel material may preferably contain about 0.03 to 0.20 wt % Cu. The addition of Cu enables secondary recrystallization to be carried out over a wider oxidization atmosphere range in terms of $P(H_2O)/P(H_2)$, and promotes stable and excellent magnetic properties. However, a Cu content over about 0.20 wt % has a harmful influence on secondary recrystallization, thus leading to a lower $B_8$ value. The addition of less than about 0.03 wt % produces no significant effect.

The silicon steel slab having the above composition can be rolled at high temperature using conventional methods. After hot-rolling, cold-rolling is performed at least once, or twice or more with intermediate annealing between the cold-rollings, so that a desired sheet thickness is obtained. The rolling reduction during the final cold-rolling should range from about 80–95%. When the rolling reduction is less than about 80%, a highly-oriented sheet is not obtainable, while a rolling reduction over about 95% fails to cause secondary recrystallization.

The steel sheet rolled to the final product thickness must contain about 0.02 to 0.10 g/m$^2$ of oxides on the surface before the decarburization annealing process. An oxide content outside of that range causes unstable initial oxidization and poor magnetic properties. The oxide content can be adjusted by controlling heating during the cold-rolling process, or by brushing or cleaning with acid during the final cold-rolling process.

In the decarburization annealing process, the steel temperature must be maintained in a range of about 800° to 850° C. for effective decarburization. A temperature below about 800° C. causes a disadvantageously lowered decarburization rate as well as poor magnetic properties, while a temperature over about 850° C. causes deterioration in coating properties and in imperfect secondary recrystallization.

The decarburization annealing oxidizing atmosphere during the steel temperature elevation phase from about 500° to 750° C. (before reaching the decarburization annealing temperature range) is important, so $P(H_2O)/P(H_2)$ must be controlled within a range of about 0.3 to 0.5, or about 0.2 to 0.65 in the case the steel has a Cu content in accordance with the present invention. A $P(H_2O)/P(H_2)$ less than about 0.3 or 0.2 tends to cause imperfect secondary recrystallization. On the other hand, when $P(H_2O)/P(H_2)$ is over about 0.5 or 0.65, secondary recrystallization becomes imperfect, and defects form on the steel sheet because of sticking and piling of the oxides, which formed in the furnace due to the excessive oxidizing atmosphere.

In the steel temperature range of about 750° to 850° C. during decarburization annealing, $P(H_2O)/P(H_2)$ must be controlled within a range of about 0.5 to 0.8 for effective decarburization and satisfactory coating. Deviation from that $P(H_2O)/P(H_2)$ range causes poor magnetic properties and poor coating appearance.

The present invention is also effective in magnetic domain refined steel sheets.

The invention will now be described through illustrative examples. The examples are not intended to limit the scope of the invention defined in the appended claims.

EXAMPLE 1

Hot-rolled sheets were made from a steel slab containing 0.078 wt % C, 3.25 wt % Si, 0.08 wt % Mn, 0.022 wt % Se, 0.024 wt % Al, and 0.0090 wt % N by hot-rolling. The sheets were cold-rolled, annealed at 1,100° C. (intermediate annealing), and again cold-rolled at 85% of the final rolling reduction to obtain a steel sheet 0.23 mm thick. Then, the surface oxide contents of the steels were varied as shown in Table 1 by cleaning and brushing. The following decarburization annealing process was carried out by choosing among four oxidizing atmosphere levels, i.e. $P(H_2O)/P(H_2)$= 0.2, 0.4, 0.5 and 0.6, respectively, by controlling steam content in the oxidizing atmosphere during the temperature elevation phase from 500° to 750° C. Then, a soaking process was carried out at 835° C. where $P(H_2O)/P(H_2)$=0.5, 0.6 or 0.7. The resulting steel sheets were evaluated in regard to secondary recrystallization and magnetic properties. The results are shown in Table 1.

In the evaluation, core loss values were continuously measured in the longitudinal direction of the coil. Where the core loss value reached a threshold level defined for each sheet thickness, the secondary recrystallization was deemed to be perfect. The excellent article rate refers to the ratio of the longitudinal length of the coil which attains the defined threshold level to the total coil length. "Normal portion" refers to the portion of the coil which has attained the defined threshold level.

TABLE 1

| Oxide content before the temperature elevation phase of decarburization annealing (g/m$^2$) | Atmosphere during the temperature elevation phase of decarburization annealing $P(H_2O)/P(H_2)$ | Atmosphere during soaking $P(H_2O)/P(H_2)$ | Secondary recrystallization | Excellent rate (%) | Magnetic induction of normal portion $B_8$(T) | Remarks |
|---|---|---|---|---|---|---|
| 0.005 | 0.2 | 0.6 | imperfect | 60 | 1.92 | unsatisfactory |
| 0.005 | 0.4 | 0.6 | imperfect | 65 | 1.88 | unsatisfactory |
| 0.005 | 0.6 | 0.6 | imperfect | 50 | 1.89 | unsatisfactory |
| 0.05 | 0.2 | 0.6 | imperfect | 70 | 1.93 | unsatisfactory |
| 0.05 | 0.4 | 0.5 | perfect | 100 | 1.93 | good |
| 0.07 | 0.4 | 0.6 | perfect | 100 | 1.94 | good |
| 0.05 | 0.6 | 0.5 | imperfect | 80 | 1.90 | unsatisfactory |
| 0.4 | 0.4 | 0.6 | perfect | 50 | 1.87 | unsatisfactory |
| 0.02 | 0.5 | 0.7 | perfect | 100 | 1.94 | good |
| 0.013 | 0.5 | 0.7 | perfect | 100 | 1.93 | good |

EXAMPLE 2

Hot-rolled sheets were made from a steel slab containing 0.079 wt % C, 3.25 wt % Si, 0.08 wt % Mn, 0.023 wt % Se, 0.025 wt % Al, 0.0085 wt % N, and 0.16 wt % Cu by hot-rolling. The sheets were cold-rolled, annealed at 1,100° C. (intermediate annealing), and again cold-rolled at 85% of final rolling reduction to obtain a steel sheet 0.23 mm thick. Then, the surface oxide content of thus produced steel sheet was adjusted to 0.05 g/m$^2$ by cleaning and brushing. The following decarburization annealing process was carried out by choosing among three oxidizing atmosphere levels, i.e. $P(H_2O)/P(H_2)$=0.2, 0.4 and 0.6, respectively, by controlling steam content in the oxidizing atmosphere during the temperature elevation phase from 500° to 750° C. Then, a soaking process was carried out at 835° C. under the condition of $P(H_2O)/P(H_2)$=0.5 or 0.6. Evaluations of the secondary recrystallization state, excellent article rate, and the magnetic properties at the normal portion were undertaken, and the results are shown in Table 2.

Table 2 indicates that excellent magnetic properties are stably obtainable when the steel contains Cu in accordance with the present invention even when $P(H_2O)/P(H_2)=0.2$ or 0.6 during the steel temperature elevation phase from 500° to 750° C. of the decarburization annealing.

TABLE 2

| Oxide content before the temperature elevation phase of decarburization annealing ($g/m^2$) | Atmosphere during the temperature elevation phase of decarburization annealing $P(H_2O)/P(H_2)$ | Atmosphere during soaking $P(H_2O)/P(H_2)$ | Secondary recrystal-lization | Excellent rate (%) | Magnetic induction of normal portion $B_8(T)$ | Remarks |
|---|---|---|---|---|---|---|
| 0.05 | 0.2 | 0.6 | perfect | 100 | 1.93 | good |
| 0.05 | 0.4 | 0.5 | perfect | 100 | 1.94 | good |
| 0.05 | 0.4 | 0.6 | perfect | 100 | 1.94 | good |
| 0.05 | 0.6 | 0.5 | perfect | 100 | 1.93 | good |

EXAMPLE 3

Hot-rolled sheets were made from a steel slab containing 0.077 wt % C, 3.25 wt % Si, 0.08 wt % Mn, 0.023 wt % Se, 0.024 wt % Al, 0.0085 wt % N, and 0.020 wt % Sb by hot-rolling. The sheets were cold-rolled, annealed at 1,100° C. (intermediate annealing), and again cold-rolled at 85% of final rolling reduction to obtain a steel sheet 0.23 mm thick. Then, the surface oxide content was adjusted to 0.05 $g/m^2$ by cleaning and brushing. The following decarburization annealing process was carried out by choosing among three oxidizing atmosphere levels, i.e. $P(H_2O)/P(H_2)=0.2$, 0.4 and 0.6, respectively, by controlling steam content of the oxidizing atmosphere during the steel temperature elevation phase from 500° to 750° C. Then, a soaking process was carried out at 835° C. under the condition of $P(H_2O)/P(H_2)=0.5$ or 0.6.

The results of the secondary recrystallization state, excellent article rate, and the magnetic properties at the normal portion are shown in Table 3.

TABLE 3

| Oxide content before the temperature elevation phase of decarburization annealing ($g/m^2$) | Atmosphere during the temperature elevation phase of decarburization annealing $P(H_2O)/P(H_2)$ | Atmosphere during soaking $P(H_2O)/P(H_2)$ | Secondary recrystal-lization | Excellent rate (%) | Magnetic induction of normal portion $B_8(T)$ | Remarks |
|---|---|---|---|---|---|---|
| 0.05 | 0.2 | 0.5 | imperfect | 60 | 1.88 | unsatisfactory |
| 0.05 | 0.2 | 0.6 | imperfect | 70 | 1.89 | unsatisfactory |
| 0.05 | 0.4 | 0.5 | perfect | 100 | 1.93 | good |
| 0.05 | 0.4 | 0.6 | perfect | 100 | 1.94 | good |
| 0.05 | 0.6 | 0.5 | perfect | 100 | 1.94 | good |
| 0.05 | 0.6 | 0.6 | perfect | 100 | 1.93 | good |

EXAMPLE 4

Hot-rolled sheets were made from a steel slab containing 0.070 wt % C, 3.25 wt % Si, 0.07 wt % Mn, 0.020 wt % Se, 0.025 wt % Al, 0.0088 wt % N, 0.12 wt % Cu, and 0.04 wt % Sb by hot-rolling. The sheets were cold-rolled, annealed at 1,100° C. (intermediate annealing), and again cold-rolled at 85% of final rolling reduction to obtain a steel sheet 0.23 mm thick. Then, the surface oxide content was adjusted to 0.05 $g/m^2$ by cleaning and brushing. The following decarburization annealing process was carried out by choosing among three oxidizing atmosphere levels, i.e. $P(H_2O)/P(H_2)=0.2$, 0.4 and 0.6, respectively, by controlling steam content in the oxidizing atmosphere during the steel temperature elevation phase from 500° to 750° C. Then, a soaking process was carried out at 835° C. under the condition of $P(H_2O)/P(H_2)=0.5$ or 0.6.

The results of the secondary recrystallization state, excellent article rate, and the magnetic properties at the normal portion are shown in Table 4.

TABLE 4

| Oxide content before the temperature elevation phase of decarburization annealing ($g/m^2$) | Atmosphere during the temperature elevation phase of decarburization annealing $P(H_2O)/P(H_2)$ | Atmosphere during soaking $P(H_2O)/P(H_2)$ | Secondary recrystal-lization | Excellent rate (%) | Magnetic induction of normal portion $B_8(T)$ | Remarks |
|---|---|---|---|---|---|---|
| 0.05 | 0.2 | 0.5 | perfect | 100 | 1.93 | good |
| 0.05 | 0.2 | 0.6 | perfect | 100 | 1.94 | good |
| 0.05 | 0.4 | 0.5 | perfect | 100 | 1.93 | good |
| 0.05 | 0.4 | 0.6 | perfect | 100 | 1.94 | good |
| 0.05 | 0.6 | 0.5 | perfect | 100 | 1.94 | good |
| 0.05 | 0.6 | 0.6 | perfect | 100 | 1.93 | good |
| 0.05 | 0.8 | 0.5 | imperfect | 70 | 1.88 | unsatisfactory |
| 0.05 | 0.8 | 0.6 | imperfect | 60 | 1.86 | unsatisfactory |

The above-mentioned examples demonstrate that controlling the atmosphere during the steel temperature elevation phase of a decarburization annealing process according to the present invention produces stabilized secondary recrystallization and excellent magnetic properties.

Although this invention has been described in connection with specific forms thereof, it will be appreciated that a wide variety of equivalents may be substituted for specific elements described herein without departing from the spirit and scope of the invention defined in the appended claims.

What is claimed is:

1. In a method for producing a grain-oriented silicon steel sheet which includes:

producing a silicon steel slab having a silicon steel slab composition;

hot-rolling said silicon steel slab to produce a silicon steel sheet;

cold-rolling said silicon steel sheet at least once, including a final cold-rolling, to produce a silicon steel sheet;

decarburization annealing said silicon steel sheet, said decarburization annealing including a temperature elevation phase and an oxidizing atmosphere, to produce decarburized silicon steel sheet;

applying an annealing separating agent to said decarburized silicon steel sheet; and final annealing said decarburized silicon steel sheet to produce said grain-oriented silicon steel sheet;

the steps which comprise:

controlling said silicon steel slab composition to comprise, as inhibitor forming components, about 0.02 to 0.15 wt % Mn, about 0.005 to 0.060 wt % Se, about 0.010 to 0.06 wt % Al, and about 0.0030 to 0.0120 wt % N;

controlling the oxide content on said silicon steel sheet surface within about 0.02 to 0.10 $g/m^2$ before said temperature elevation phase in said decarburization annealing;

maintaining the ratio of steam partial pressure to hydrogen partial pressure in said oxidizing atmosphere within a range of about 0.3 to 0.5 when said silicon steel sheet has a surface temperature ranging from about 500° to 750° C. during said temperature elevation phase in said decarburization annealing; and maintaining the ratio of steam partial pressure to hydrogen partial pressure in said oxidizing atmosphere within a range of about 0.5 to 0.8 when said silicon steel sheet has a surface temperature ranging from about 750° to 850° C. during said decarburization annealing.

2. In a method for producing a grain-oriented silicon steel sheet which includes:

producing a silicon steel slab having a silicon steel slab composition;

hot-rolling said silicon steel slab to produce a silicon steel sheet;

cold-rolling said silicon steel sheet at least once, including a final cold-rolling, to produce a silicon steel sheet;

decarburization annealing said silicon steel sheet, said decarburization annealing including a temperature elevation phase and an oxidizing atmosphere, to produce a decarburized silicon steel sheet;

applying an annealing separating agent to said decarburized silicon steel sheet; and final annealing said decarburized silicon steel sheet to produce said grain-oriented silicon steel sheet;

the steps which comprise:

controlling said silicon steel slab composition to comprise about 0.03 to 0.10 wt % Cu, and, as inhibitor forming components, about 0.02 to 0.15 wt % Mn, about 0.005 to 0.060 wt % Se, about 0.010 to 0.06 wt % Al, and about 0.0030 to 0.0120 wt % N;

controlling the oxide content on said silicon steel sheet surface within about 0.02 to 0.10 $g/m^2$ before said temperature elevation phase in said decarburization annealing;

maintaining the ratio of steam partial pressure to hydrogen partial pressure in said oxidizing atmosphere within a range of about 0.2 to 0.65 when said silicon steel sheet has a surface temperature ranging from about 500° to 750° C. during said temperature elevation phase in said decarburization annealing; and maintaining the ratio of steam partial pressure to hydrogen partial pressure in said oxidizing atmosphere within a range of about 0.5 to 0.8 when said silicon steel sheet has a surface temperature ranging from about 750° to 850° C. during said decarburization annealing.

3. The method according to claim 1, further comprising: controlling said silicon steel slab composition to comprise about 0.04 to 0.12 wt % C and about 2.0 to 4.5 wt % Si;

performing said final cold-rolling with a rolling reduction ranging from about 80–95%; and conducting said decarburization annealing at a temperature between about 800° to 850° C.

4. The method according to claim 2, further comprising: controlling said silicon steel slab composition to comprise about 0.04 to 0.12 wt % C and about 2.0 to 4.5 wt % Si;

performing said final cold-rolling with a rolling reduction ranging from about 80–95%; and conducting said decarburization annealing at a temperature between about 800° to 850° C.

* * * * *